US005657063A

United States Patent [19]

Takahashi

[11] Patent Number: 5,657,063

[45] Date of Patent: Aug. 12, 1997

[54] INK JET APPARATUS

[75] Inventor: Yoshikazu Takahashi, Kasugai, Japan

[73] Assignee: Brother Kogyo Kabushiki Kaisha, Nagoya, Japan

[21] Appl. No.: 148,383

[22] Filed: Nov. 8, 1993

[30] Foreign Application Priority Data

Feb. 22, 1993 [JP] Japan ..... 5-031670

[51] Int. Cl.[6] ..... B41J 2/14

[52] U.S. Cl. ..... 347/69

[58] Field of Search ..... 347/68, 69; 310/328, 310/330

[56] References Cited

U.S. PATENT DOCUMENTS

| | | | |
|---|---|---|---|
| 4,879,568 | 11/1989 | Bartky et al. | 347/69 |
| 4,887,100 | 12/1989 | Michaelis et al. | 347/69 |
| 5,016,028 | 5/1991 | Temple | 347/69 |
| 5,248,998 | 9/1993 | Ochiai et al. | 347/69 X |
| 5,252,994 | 10/1993 | Narita et al. | 347/69 X |

FOREIGN PATENT DOCUMENTS

| | | |
|---|---|---|
| 57-068091 | 4/1982 | Japan . |
| 57-082165 | 5/1982 | Japan . |
| 57-207385 | 12/1982 | Japan . |
| 62-179783 | 8/1987 | Japan . |
| 2-272781 | 11/1990 | Japan . |
| 4-369914 | 12/1992 | Japan . |
| 5-17216 | 1/1993 | Japan . |
| WO92/22429 | 12/1992 | WIPO . |

*Primary Examiner*—Huan H. Tran
*Attorney, Agent, or Firm*—Oliff & Berridge

[57] ABSTRACT

An ink jet apparatus applies a drive voltage to electrodes formed on portions of side walls made of piezoelectric ceramics and varies the internal volumes of grooves adjacent to the side walls using the action of a deformation produced by a piezoelectric thickness/slip effect of the piezoelectric ceramics. Thereby, ink stored inside the grooves is ejected. According to such an ink jet apparatus, a void ratio of the piezoelectric ceramic is 10% or less, and an average crystal grain diameter of the piezoelectric ceramics is 10 μm or less. Further, a variation in a ratio $d_{15}/S_{E44}$ of a piezoelectric constant $d_{15}$ of the piezoelectric ceramic to an elastic compliance $S_{E44}$ thereof between the side walls falls within 4. A ratio H/W of a height H of each side wall to a width W thereof ranges from above 2 to below 9, and a ratio $d_{15}/S_{E44}$ of a piezoelectric constant $d_{15}$ of the piezoelectric ceramic to an elastic compliance $S_{E44}$ thereof is 10 or more. It is thus possible to provide an ink jet apparatus having excellent durability and high reliability.

13 Claims, 9 Drawing Sheets

INK JET APPARATUS

BACKGROUND OF THE INVENTION

1. Field of the Invention

The present invention relates to an ink jet apparatus and, particularly, to a void ratio and an average crystal grain diameter of piezoelectric ceramics.

2. Description of the Related Art

Known printer heads include drop-on-demand type ink jet printer heads that utilize piezoelectric ceramics. In these drop-on-demand type ink jet printer heads, the volume of the ink chambers (ink channels) is varied by the deformation of a piezoelectric ceramic. The deformation thereby jets or ejects ink stored in the ink chambers from nozzles as droplets due to a reduction in the volume of the ink chamber. The deformation also causes ink to be introduced into the ink chambers from other ink introduction paths due to an increase in the volume. In print heads using such an ink ejecting device or jet apparatus, ink jet mechanisms are disposed adjacent to each other and droplets of ink are ejected from the ink jet mechanism located at a desired position according to desired print data. Thus, desired characters and images are formed on a sheet or the like disposed in opposing relationship to the ink jet mechanism.

Such an ink jet apparatus is known in U.S. Pat. Nos. 4,879,568, 4,887,100 and 5,016,028, for example. FIGS. 7, 8, 9 and 10 of this application are schematic views showing conventional examples, respectively.

The structure of the conventional example will be specifically described below with reference to FIG. 7 showing a cross-sectional view of the ink jet apparatus. The ink jet apparatus comprises a plurality of side walls 11 and a plurality of ink chambers 12 spaced away from each other in the transverse direction. The ink chambers 12 are formed by bonding a piezoelectric ceramic plate 1 subjected to polarization processing in the direction indicated by the arrow 4 to a cover plate 2 composed of a ceramic material or a resinous material or the like with adhesive layers 3 of an epoxy adhesive or the like interposed therebetween. Each of the ink chambers 12 has a rectangular cross-section and is shaped in an elongated manner. Each of the side walls 11 extends over the overall length of each ink chamber 12. Metal electrodes 13 used for application of drive electric fields are formed on both surfaces, each extending from the upper portion adjacent to each adhesive layer 3 of each side wall 11 to the central portion thereof. All of the ink chambers are filled with ink during operation.

The operation of the conventional example will now be described with reference to FIG. 8 showing a cross-sectional view of the ink jet apparatus. When, for example, an ink chamber **12*b* in the ink jet apparatus is selected according to desired print data, a positive drive voltage is gradually applied to metal electrodes 13*e* and 13*f* and metal electrodes 13*d* and 13*g* are grounded. Thus, a drive electric field in the direction indicated by the arrow 14*b* is exerted on a side wall 11*b*, whereas a drive electric field in the direction indicated by the arrow 14*c* is exerted on a side wall 11*c*. Since, at this time, the drive electric field directions 14*b* and 14*c* and a polarization direction 4 meet at right angles to each other, the side walls 11*b* and 11*c* are deformed in an outer direction of the ink chamber 12*b* by a piezoelectric thickness/slip effect. The volume of the ink chamber 12*b* increases due to the deformation, and hence ink pressure decreases. Thus, the ink is supplied from an ink supply hole 21 (see FIG. 9) to the ink chamber 12*b* via a manifold 22. When the application of the drive voltage to the metal electrodes 13*e* and 13*f* is abruptly stopped, each of the side walls 11*b* and 11*c* is rapidly returned to the original position before their deformation. Therefore, the ink pressure in the ink chamber 12*b* is abruptly raised and a pressure wave is produced. As a result, droplets of ink are ejected or jetted from a nozzle 32 that communicates with the ink chamber 12*b***.

The structure of the conventional ink jet apparatus and a method of producing it will next be described with reference to FIG. 9, which is illustrative of a perspective view of the ink jet apparatus. A plurality of parallel grooves 12, which form the aforementioned ink chambers, are defined in a piezoelectric ceramic plate 1 subjected to polarization processing by a grinding process using a thin disc-shaped diamond blade. The grooves 12 are identical in depth and parallel to each other substantially over the entire region of the piezoelectric ceramic plate 1. However, the grooves 12 gradually become shallow as they reach an end face 15 of the piezoelectric ceramic plate 1 and merge into grooves 16, which are parallel and shallow in the vicinity of the end face 15. The metal electrodes 13 are formed on the internal faces of the grooves 12 and 16 respectively by sputtering or the like. The metal electrodes 13 are formed only on the upper halves the side faces of the grooves 12. On the other hand, the metal electrodes 13 are also formed on side faces and entire bottom faces of the grooves 16 as seen in FIG. 9.

Further, an ink introduction hole 21 and a manifold 22 are defined in a cover plate 2 made of a ceramic material or a resinous material or the like by grinding or cutting or the like. Next, the surface on the groove processed side of the piezoelectric ceramic plate 1 and the surface on the manifold processed side of the cover plate 2 are bonded to each other by epoxy adhesive or the like so that the respective grooves define the ink chambers having the above shapes. A nozzle plate 31 having nozzles 32 defined therethrough at positions corresponding to the positions of the ink chambers is bonded to the end faces of the piezoelectric plate 1 and the cover plate 2. Further, a substrate 41 having conductive layer patterns 42 formed therein at positions corresponding to the positions of the ink chambers is bonded to the surface of the piezoelectric ceramic plate 1, which is located on the side opposite to the surface on the groove processed side, by epoxy adhesive or the like. Then, the metal electrodes 13 provided on the bottoms of the grooves 16 and the patterns 42 are electrically connected to one another with conductors or lead wires 43 by wire bonding.

The structure of a controller employed in the conventional example will next be described with reference to FIG. 10 showing a block diagram of the controller. The conductive layer patterns 42 formed in the substrate 41 are respectively electrically connected to a corresponding LSI chip 51. Further, a clock line 52, a data line 53, a voltage line 54 and a ground line 55 are also electrically connected to the LSI chip 51. Responsive to a train clock pulse supplied from the clock line 52, the LSI chip 51 decides or determines, based on data that appears on the data line 53, from which nozzle the droplets of ink should be jetted or ejected. Thereafter, the LSI chip 51 applies a voltage supplied from the voltage line 54 to the patterns 42 electrically connected to the driven metal electrodes in the appropriate ink chambers. Further, the LSI chip 51 applies a voltage of 0 at the ground line 55 to the patterns 42 electrically connected to the metal electrodes in the ink chambers that are not to be activated.

However, the relationship between the endurance of the jet and the characteristics of the piezoelectric ceramic material is unclear in the conventional ink jet apparatus described above. Further, the selection of the material is based on the experience of the person in charge of production. Therefore, often the selected piezoelectric ceramic material has poor durability. Hence, the reliability of the ink jet apparatus is low. Further, the ink jet apparatus often has a large variation in drive voltage between the side walls required to stabilize print quality. Thus, the cost of a circuit for stabilizing the print quality increases. Moreover, the drive circuit system is large in structure because of a very high drive voltage, and the cost for taking an insulating measure increases.

SUMMARY OF THE INVENTION

The present invention has been made to solve the aforementioned problems. It is therefore a primary object of the present invention to provide an ink jet apparatus having excellent endurance characteristics and high reliability.

According to one aspect of the present invention for achieving the above and other objects, an ink jet apparatus is provided for applying a drive voltage to electrodes formed on portions of side walls made of piezoelectric ceramics to vary the internal volumes of grooves adjacent to the side walls using the action of a deformation produced by a piezoelectric thickness/slip effect of the piezoelectric ceramics. Thereby, ink stored inside the grooves is ejected. The invention is characterized in that a void ratio of the piezoelectric ceramic is 10% or less and an average crystal grain diameter of the piezoelectric ceramics is 10 μm or less. The ratio of the piezoelectric constant to the elastic compliance between the side walls varies by 4.

According to the above ink jet apparatus, the mechanical strength of each of the side walls can be made greater because the void ratio of the piezoelectric ceramic is 10% or less and the average crystal grain diameter of the piezoelectric ceramics is 10 μm or less.

According to the ink jet apparatus of the present invention, as is apparent from the above description, the void ratio of the piezoelectric ceramic is 10% or less and the average crystal grain diameter is 10 μm or less. It is therefore possible to provide an ink jet apparatus having excellent durability and high reliability.

The above and other objects, features and advantages of the present invention will become apparent from the following description and the appended claims, taken in conjunction with the accompanying drawings showing a preferred embodiment of the present invention by illustrative example.

DETAILED DESCRIPTION OF PREFERRED EMBODIMENTS

Figure 1:
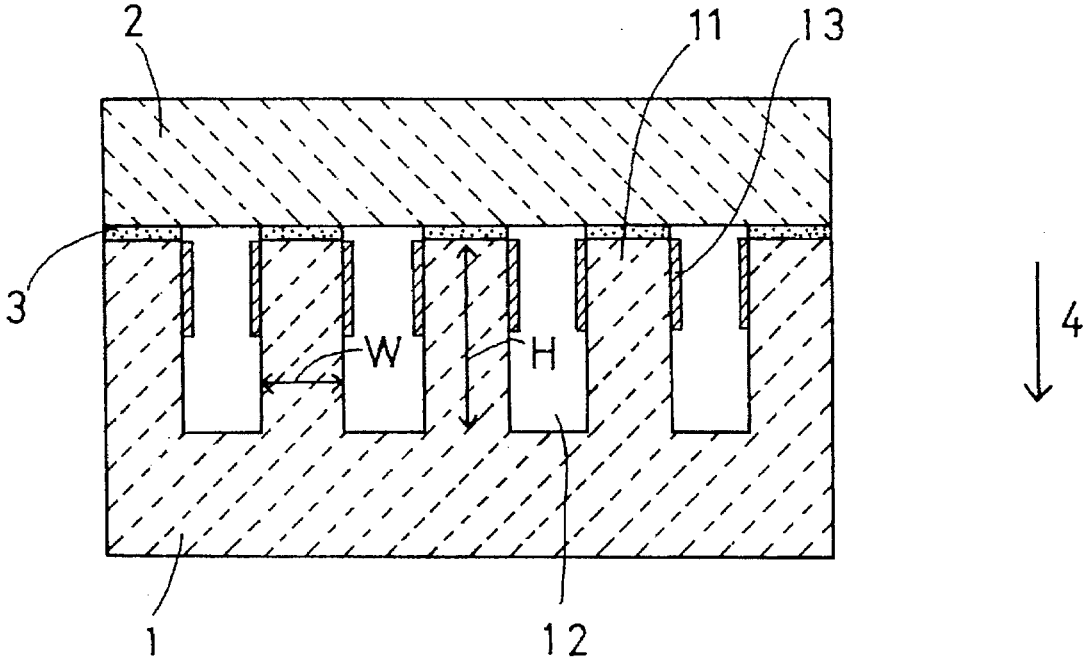
FIG. 1 is a cross-sectional view showing an ink jet apparatus according to one embodiment of the present invention.

The present invention will hereinafter be described in detail with reference to the accompanying drawings in which one specified embodiment is shown by illustrative example. Incidentally, the same elements of structure as those in the conventional example of FIGS. 7–10 and the elements of structure similar to those in the conventional example are identified by like reference numerals for convenience of illustration.

As shown in FIG. 1, the ink jet apparatus according to the preferred embodiment comprises a plurality of side walls 11 each having a height of preferably 0.4 mm, a width of preferably 0.1 mm and a ratio H/W of the height H of each side wall to the width W thereof. A plurality of ink chambers 12 are spaced away from each other in the transverse direction and are formed by bonding a piezoelectric ceramic plate 1 subjected to polarization processing in the direction indicated by the arrow 4 to a cover plate 2 composed of a ceramic material or a resinous material or the like. The piezoelectric ceramic plate 1 and cover plate 2 are bonded with adhesive layers 3 formed of epoxy adhesive or the like interposed therebetween. Each of the ink chambers 12 has a rectangular cross-section and is shaped in an elongated manner. Each of the side walls 11 extends over the overall length of each ink chamber 12. Metal electrodes 13 used for application of drive electric fields are formed on both surfaces, each extending from the upper portion adjacent to each adhesive layer 3 of each side wall 11 to the central portion thereof. In operation, all the ink chambers are filled with pigment ink preferably using TPM (tripropylene glycol methyl ether) as a base.

As a result of experimentation, the ratio H/W of the height of each side wall 11 to the width thereof was set to 4 in the present embodiment. To develop the relationship between the value 4 and pressure P generated within each ink chamber 12, an ink jet apparatus having different ratios H/W of height to width of various side walls was experimentally produced. The same drive voltage was applied to or across each of the metal electrodes 13, and the pressure P produced within each of the ink chambers 12 was measured. In this example, the side walls 11 of the produced ink jet apparatus fall within a width W range of 0.04 mm to 0.12 mm and a height H range of 0.1 mm to 0.6 mm. The length of each metal electrode 13 is about ½ the height of each side wall 11, and a drive voltage to be applied across each metal electrode 13 is 40 V.

Figure 2:
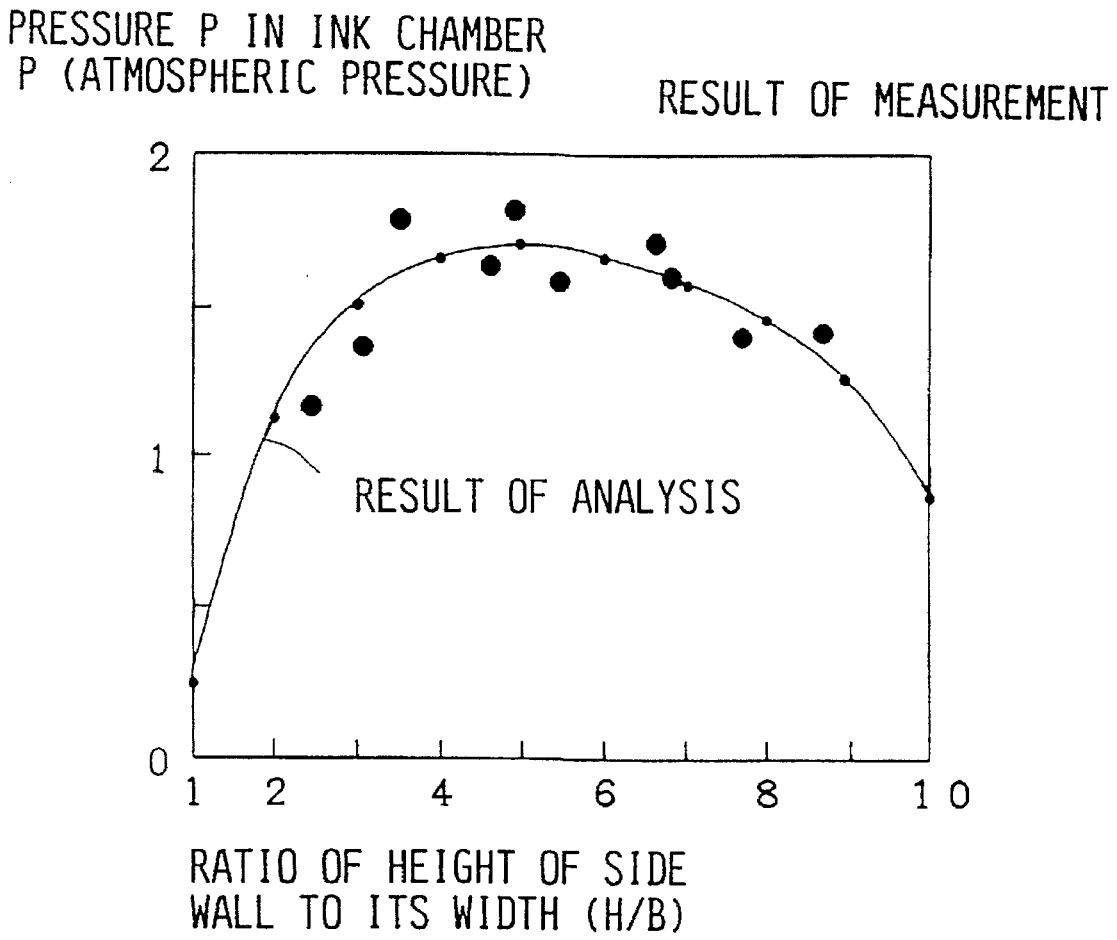
FIG. 2 is a graph describing the relationship between the ratio H/W of the height of a side wall to the width thereof and pressure P in an ink chamber.

The pressure generated in each ink chamber 12 was measured by the following method. A parallel laser beam was radiated into the ink chambers 12 from an upper position of the transparent cover plate 2 via an objective lens of a metal scope. A difference in phase between the laser beam reflected from the bottom of each ink chamber 12 and transmitted through the objective lens again and an irradiated laser beam was detected when the laser beam was focused on the bottom of each ink chamber 12. When the refractive index varies with a change in pressure of the TPM in each ink chamber 12, the time necessary for the laser beam to pass through each ink chamber 12 varies. Thus, the pressure in each of the ink chambers 12 can be measured by detecting a variation in the phase difference. The result of such a measurement shows that the ratio H/W of the height to the width of each side wall 11 ranges from above 2.5 to below 8 and the pressure in each ink chamber 12 is substantially brought to the maximum as shown in FIG. 2.

Then another model was produced having a piezoelectric ceramic plate 1, side walls 11 whose height-to-width ratios H/W range from 1 to 10, adhesive layers 3 and a cover plate 2. Further, a numerical analysis was performed according to the finite element method to examine the relationship between the height-to-width ratios H/W and the pressure P in the ink chambers 12. The pressure P in each ink chamber 12 can be estimated as $P=K\cdot\Delta V/C$ where $\Delta V$ represents the amount of a static deformation of each side wall 11 at the time that the drive voltage is applied to or across each metal electrode 13 where ink is not introduced into the ink chambers 12, i.e., the amount of decrease in volume of each ink chamber 12. C represents the amount of a static deformation of each side wall 11 at the time of application of the pressure P to the surface of each side wall 11, i.e., the compliance of each side wall 11. K represents a constant determined by piezoelectric characteristics and mechanical characteristics of the piezoelectric ceramic plate 1 and compression characteristics of the ink and the like. The result of the analysis showed that when the height-to-width ratio H/W of each side wall 11 ranges from above 2.5 to below 8, the pressure in each ink chamber 12 takes a value of about 85% or more of the maximum value. When the height-to-width ratio H/W ranges from above 2 to below 9, the pressure in each ink chamber 12 assumes a value of above 70% of the maximum value as shown in FIG. 2. This result coincides with the above result of measurement.

In the ink jet apparatus according to the present embodiment, it has been found from the above experimental results that the pressure generated in the ink chambers 12 could be efficiently raised by setting the height-to-width ratio H/W of each of the side walls with the grooves left therebetween to preferably a range from above 2 to below 9. More preferably, a range is set from above 2.5 to below 8. That is, high pressure can be generated in each ink chamber 12 by a low drive voltage and droplets of ink can be ejected or jetted at a velocity or speed and in a volume enough to form characters and images. According to this ink jet apparatus, the speed of the ink droplets can be set to a range from 3 m/sec to 8 m/sec, and the volume can be set to a range from 30 pl to 90 pl under a low drive-voltage range of 20 to 50 V. Further, a drive circuit can be simplified and reduced in size, and the ink jet apparatus can be reduced in cost and size over its entirety. Thus, the height-to-width ratio H/W was set to 4 in the present embodiment.

Figure 3:
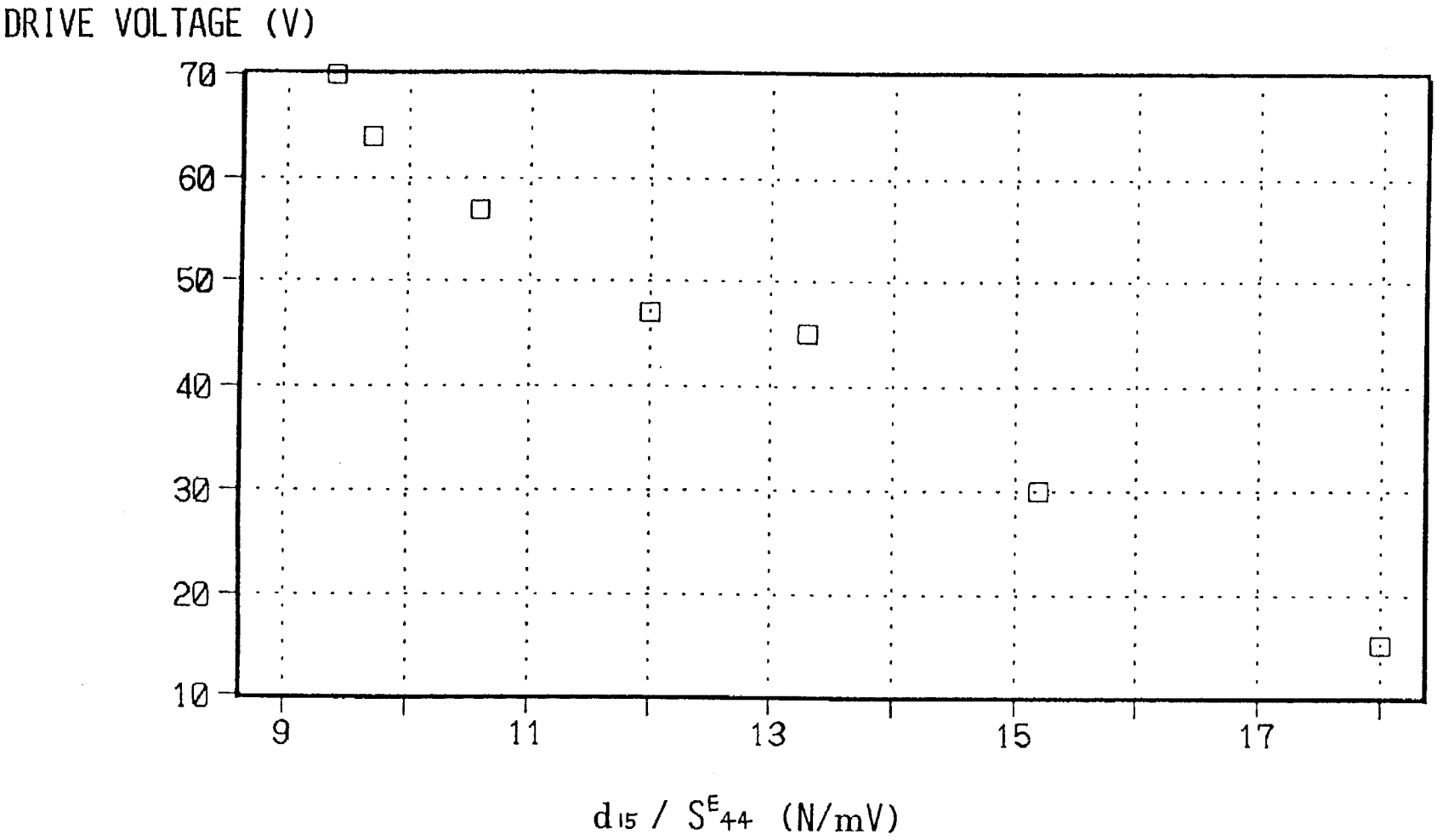
FIG. 3 is a graph explaining the relationship between the ratio $d_{15}/S_{E44}$ of a piezoelectric constant $d_{15}$ of a piezoelectric ceramic to an elastic compliance $S_{E44}$ thereof and a drive voltage used for the ejection of ink.

Next, a sample piezoelectric ceramic plate 1 was manufactured using lead titanate zirconate type piezoelectric ceramics having seven kinds of compositions. In the sample, the ceramic has an average crystal grain diameter and a void ratio of 5 μm and 3%, respectively, and ratios $d_{15}/S_{E44}$ of piezoelectric constants $d_{15}$ to elastic compliances $S_{E44}$ different from each other. FIG. 3 shows the result of measurements of the ratios $d_{15}/S_{E44}$ of the actually-produced seven kinds of piezoelectric ceramic materials. Also shown are the result of measurements of drive voltages required to eject or jet ink at a jet speed of 5 m/s free of problems with print quality using a drive circuit similar to that employed in the conventional example shown in FIG. 10.

As is apparent from FIG. 3, there is a mutual relationship between the ratio $d_{15}/S_{E44}$ of the piezoelectric constant $d_{15}$ of the piezoelectric ceramic material to the elastic compliance $S_{E44}$ thereof and the drive voltage required to eject the ink. It is understood that when the ratio $d_{15}/S_{E44}$ is made greater, the drive voltage can be lowered. Further, when the drive voltage is made lower, a drive power circuit can be reduced in cost. Described specifically, when the drive voltage is 60 V or lower, a monolithic IC can be easily fabricated. Further, when the drive voltage is 48 V or lower, there is no need for special protection to provide insulation based on the safety standard. Therefore, the ink jet apparatus was formed by piezoelectric ceramics having such composition that $d_{15}/S_{E44}$ is 10 or above, more preferably, 12 or above in the present embodiment.

Incidentally, such a measurement was effected on both the ink jet apparatus in which the ratio H/W is 2 and the ink jet apparatus in which the ratio H/W is 9. However, the result of measurement, which is substantially similar to the above result, was obtained. It can be thus said that any one of the ink jet apparatus in which the ratio H/W ranges from above 2 to below 9 may preferably use the piezoelectric ceramic material having such composition that $d_{15}/S_{E44}$ is 10 or more. More preferably, $d_{15}/S_{E44}$ 12 or more to reduce the drive voltage.

Print quality is influenced by the piezoelectric ceramic material forming the side walls and the respective ejection or jet mechanisms that differ in jet speed from each other. If the ink jet speed is set to fall within ±0.5 m/s between the respective jet mechanisms, then there is no problem in print quality. When, on the other hand, a variation in the ink jet speed exceeds ±0.5 m/s, the variation in the ink jet speed should be brought into uniformity by respectively adjusting drive voltages applied to the respective jet mechanisms. Therefore, the ink jet velocities at the time the drive voltage was fixed to 60 V were measured using the aforementioned seven kinds of piezoelectric ceramic materials whose $d_{15}/S_{E44}$ differ from each other. The result of this measurement is shown in FIG. 4.

Figure 4:
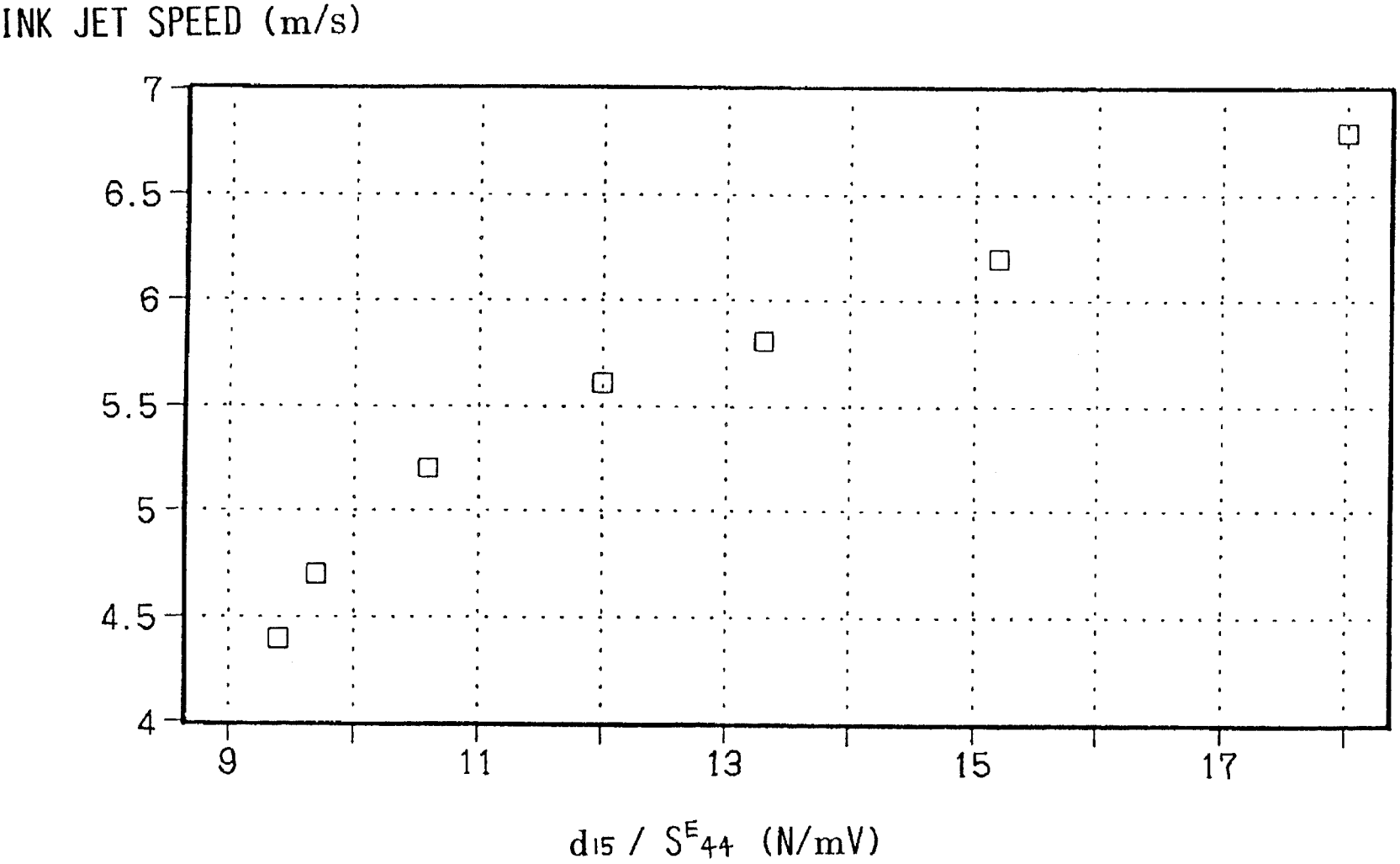
FIG. 4 is a graph describing the relationship between $d_{15}/S_{E44}$ and ink jet speed.

According to the measured result shown in FIG. 4, it was found that a variation in the ratio $d_{15}/S_{E44}$ of the piezoelectric constant $d_{15}$ of the piezoelectric ceramic material to the elastic compliance $S_{E44}$ thereof, rather than an inclination or gradient (about 0.25 $m^2V/sN$) of the graph shown in FIG. 4, might preferably be set to fall within 4. This sets the variation in the ink jet speed to fall within ±0.5 m/s when the drive voltage is set constant.

Thus, in the present embodiment, the ink jet apparatus was formed by such a piezoelectric ceramic that the variation in the ratio $d_{15}/S_{E44}$ falls within 4.

Figure 5:
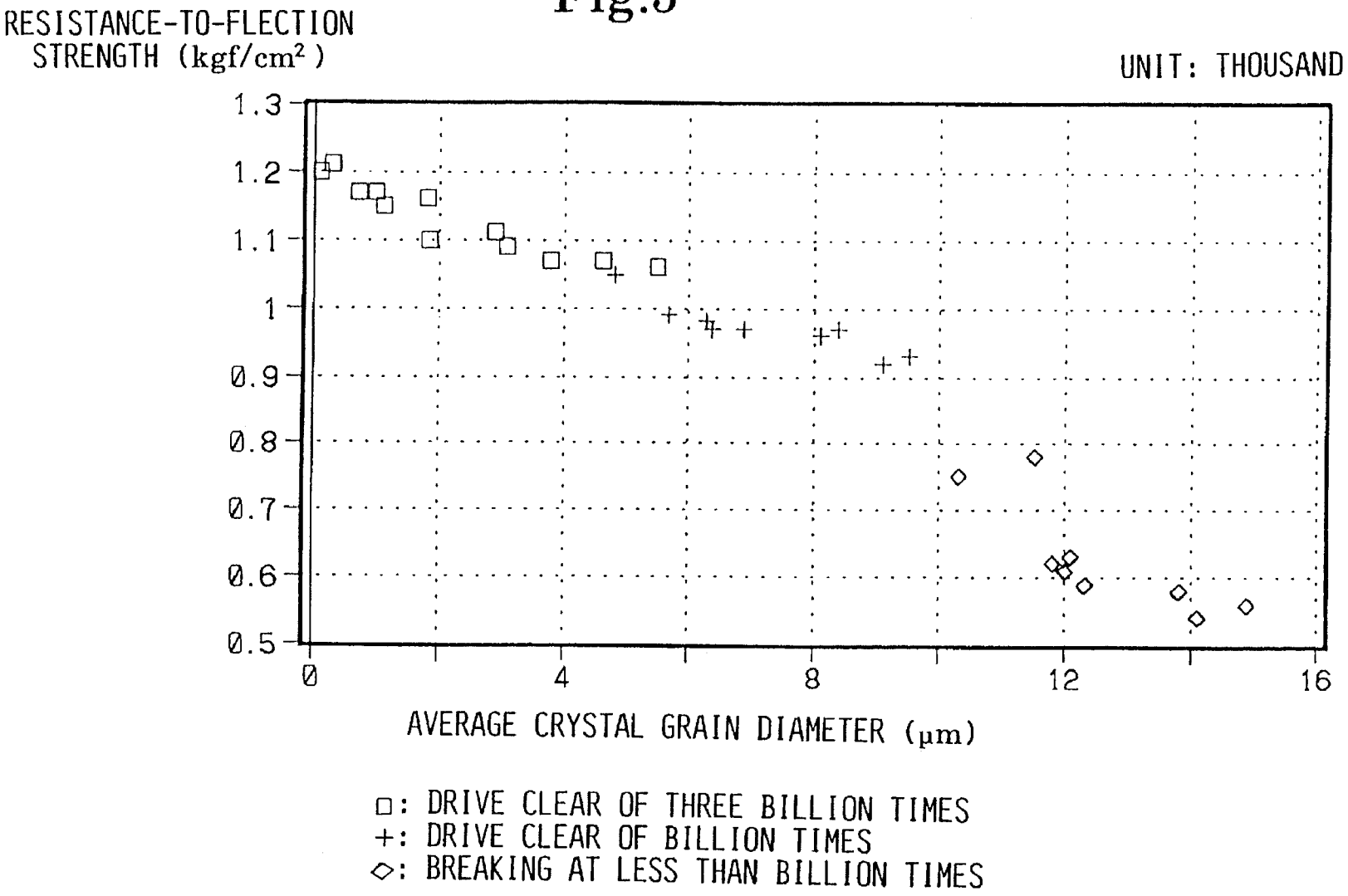
FIG. 5 is a graph explaining the relationship between the average crystal grain diameter of piezoelectric ceramics, the resistance-to-flection strength thereof and the result of an endurance test.
Figure 6:
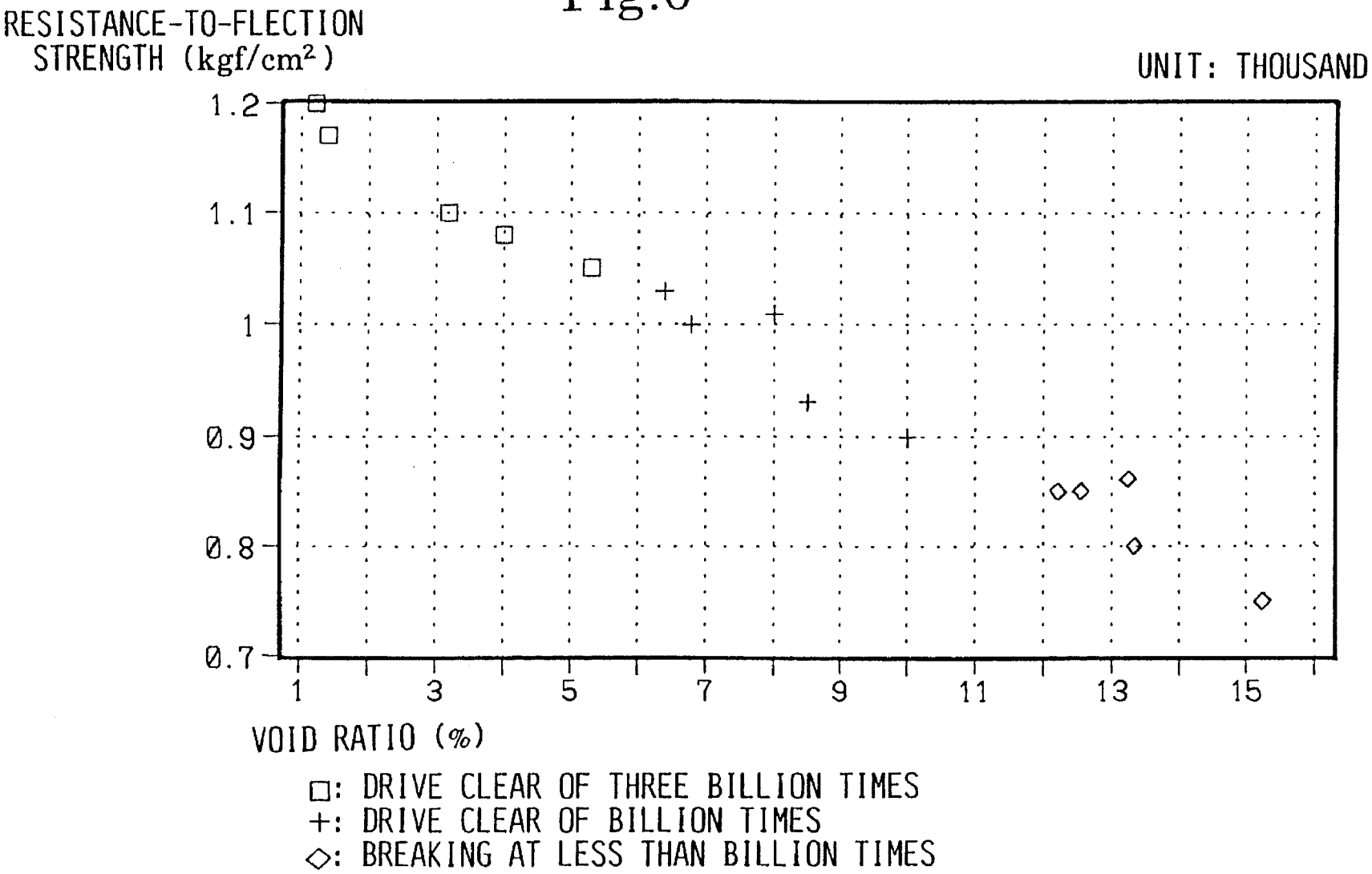
FIG. 6 is a graph describing the relationship between a void ratio of the piezoelectric ceramic, the resistance-to-flection strength thereof and the result of an endurance test.
Figure 7:
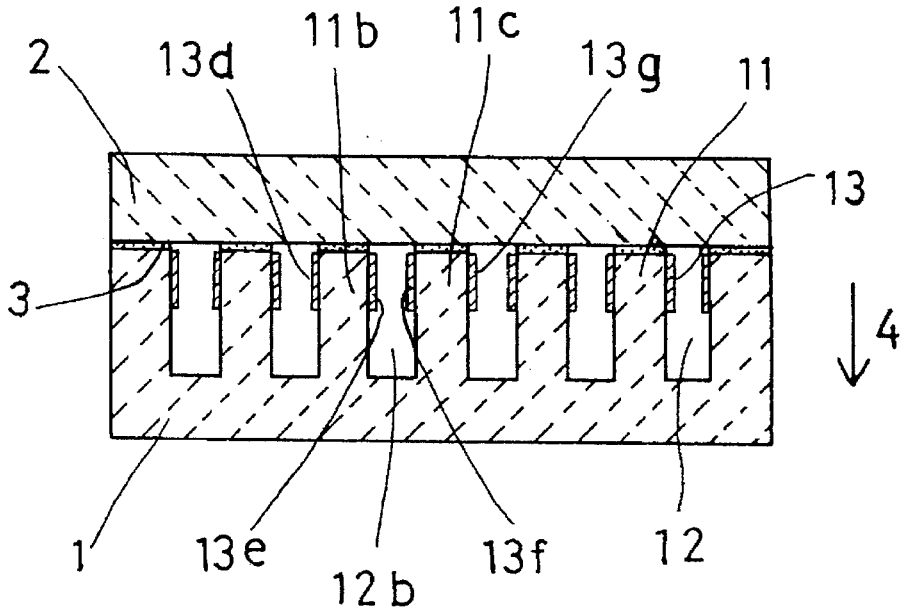
Fig.7 PRIOR ART
FIG. 7 is a cross-sectional view showing a conventional ink jet apparatus.
Figure 8:
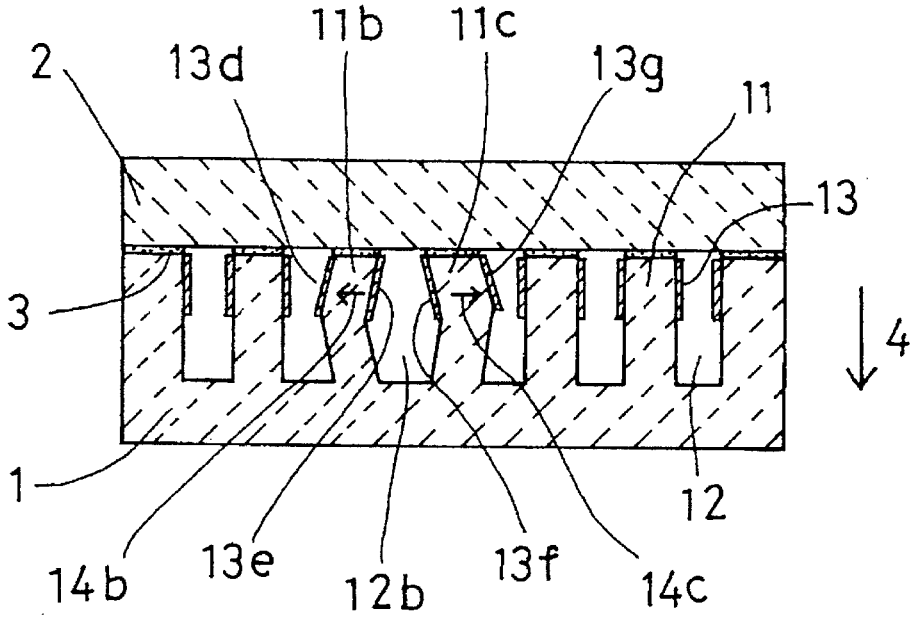
Fig.8 PRIOR ART
FIG. 8 is a cross-sectional view for the operation of the ink jet apparatus shown in FIG. 7.
Figure 9:
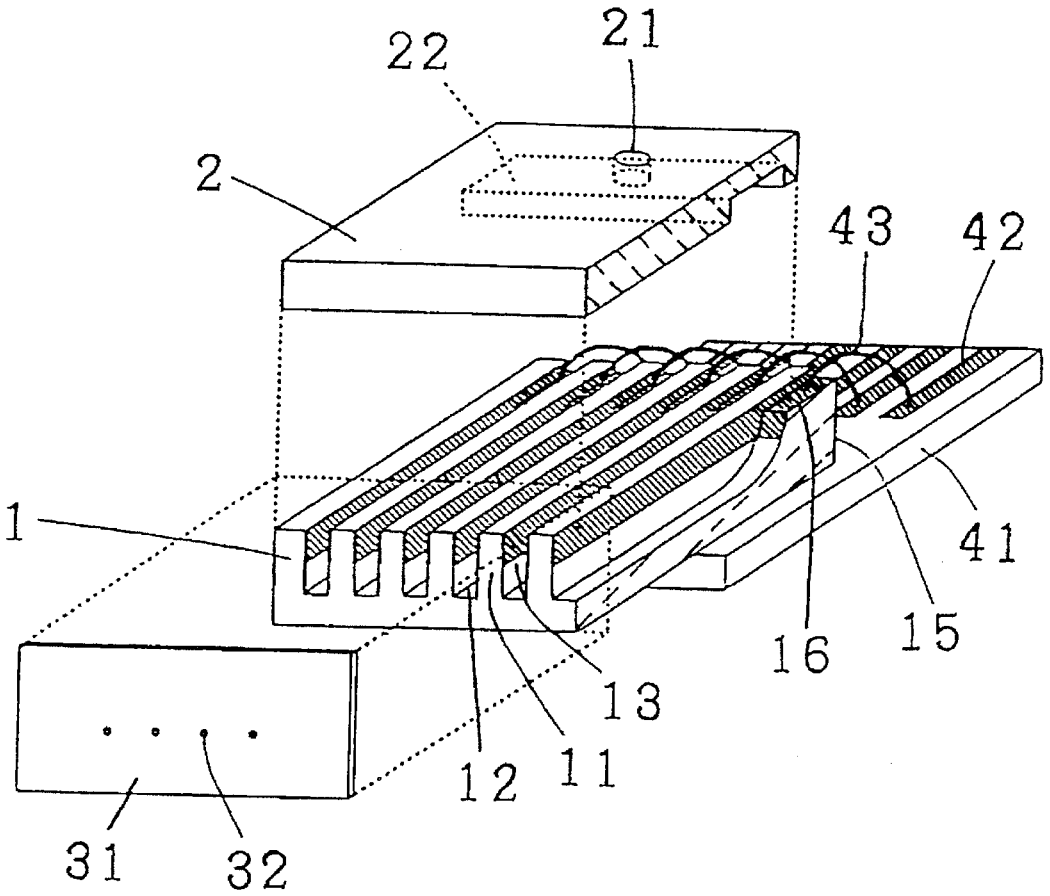
Fig.9 PRIOR ART
FIG. 9 is an exploded perspective view describing the structure of the ink jet apparatus shown in FIG. 7 and a method of fabricating the ink jet apparatus shown in FIG. 7.
Figure 10:
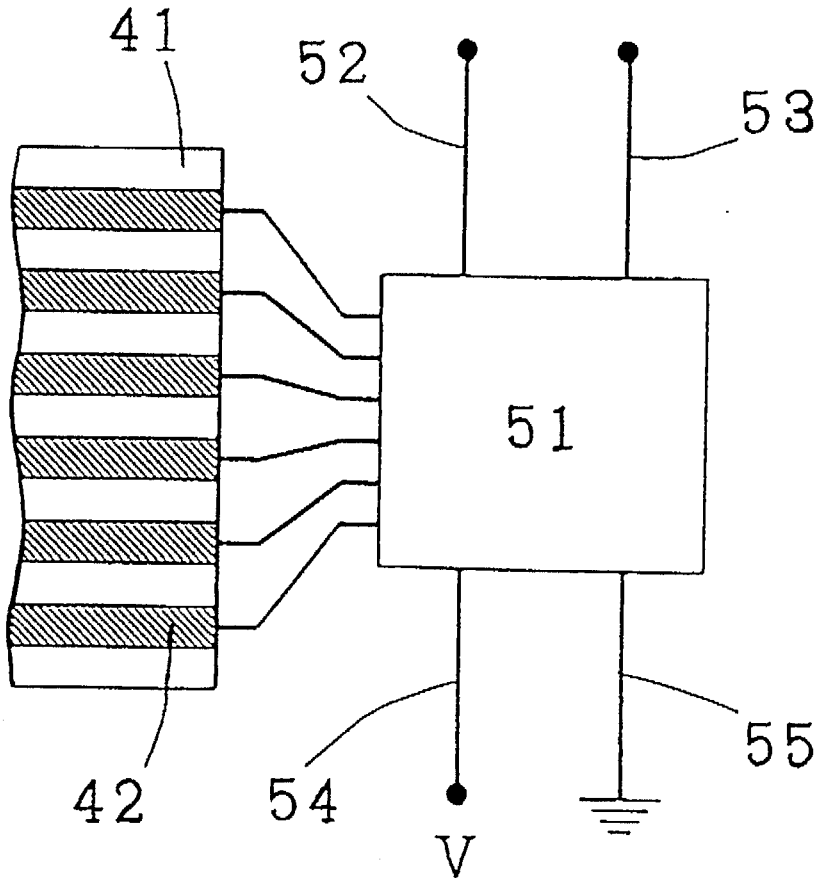
Fig.10 PRIOR ART
FIG. 10 is a partial schematic diagram showing a controller of the ink jet apparatus shown in FIG. 7.

It was further found from the following measurement that the strength of the piezoelectric ceramic has a large influence on the reliability of the ink jet apparatus. A hot press process was effected on a molded body composed of piezoelectric ceramic powder having a composition at a low temperature of about 1000° C. and under a high pressure of 900 $kg/mm^2$. Further, a ceramic having an average crystal grain diameter of 1 μm or less was prepared. Thereafter, a subsequent heat-treating temperature and the time interval were varied, and a piezoelectric ceramic material having an average crystal-grain diameter range from below 1 μm to 15 μm and a void ratio of 2% or less was obtained. In this condition, the strength of resistance of the piezoelectric material to flection was measured and an endurance and drive test of an ink jet apparatus formed by the obtained piezoelectric ceramic material was performed. The results of the measurement and test are shown in FIG. 5. Then, a piezoelectric ceramic material having a void ratio ranging from 1% to 20% and an average crystal grain diameter ranging from 3 μm to 4 μm was obtained by the above technique and the amount of resinous binders of the molded body composed of the piezoelectric ceramic powder was varied. In this condition, the strength of resistance of the obtained piezoelectric ceramic material to flection was measured and an endurance and drive test of an ink jet apparatus formed by the piezoelectric ceramic material was performed. The results of the measurement and test are shown in FIG. 6. If the piezoelectric material having a void ratio of above 15% is used, it cannot be then subjected to polarization processing. Thus, characteristics of the piezoelectric ceramic material were not shown.

As is apparent from FIGS. 5 and 6, no breaking occurs even if the piezoelectric ceramic material having a resistance-to-flection strength of above 900 kgf/cm2 is successively driven a billion times. Therefore, the reliability of the ink jet apparatus becomes high. Further, since no breaking is developed even if the piezoelectric ceramic material having the resistance-to-flection strength of above 1050 kgf/cm2 is successively driven three billion times, the reliability of the ink jet apparatus is sufficient. Thus, the strength of the piezoelectric ceramic material has a large influence on the reliability of the ink jet apparatus. It was found that the material having the resistance-to-flection strength of above 900 kgf/cm2 might preferably be used to produce the ink jet apparatus which is high in reliability.

As a result of the endurance test of the ink jet apparatus formed by piezoelectric ceramic materials having various void ratios and various average crystal grain diameters according to the aforementioned technique, no breaking is produced. This is true even if the successive drive process is performed a billion times provided that the average crystal grain diameter is 10 μm or lower (see FIG. 5) and the void ratio falls within 10% (see FIG. 6). It was thus found that the ink jet apparatus having high reliability could be fabricated.

According to the above construction, the ink jet apparatus is formed having high durability, which is capable of reducing the drive voltage required to eject ink at an ink jet speed of 5 m/s to 60 V or lower. The above apparatus also provides satisfactory print quality and no breaking even if the piezoelectric ceramic material is successively activated a billion times.

Having now fully described the invention, it will be apparent to those skilled in the art that many changes and modifications can be made without departing from the spirit or scope of the invention as set forth in the appended claims.

What is claimed is:

1. An ink jet apparatus comprising:

a piezoelectric ceramic plate having a plurality of longitudinally extending grooves formed therein, each groove being defined by a pair of spaced side walls, and electrodes disposed on each side wall; and a cover plate coupled to said ceramic plate, said cover plate and said grooves defining a plurality of ink chambers; and a voltage source for applying drive voltage to said electrodes to selectively eject ink from each ink chamber, said ink chambers being expandable and contractible upon application of voltage to said electrodes, wherein said piezoelectric ceramic plate has a void ratio of 10% or less and has an average crystal grain diameter of 10 μm or less and greater than 0, and wherein said piezoelectric ceramic plate has a piezoelectric constant $d_{15}$ and an elastic compliance $S_{E44}$ and a ratio of said piezoelectric constant $d_{15}$ to said elastic compliance $S_{E44}$ of said plate is 10 or more, each side wall having a different ratio of said piezoelectric constant $d_{15}$ to said elastic compliance $S_{E44}$ due to changes in the piezoelectric material of said side walls that occur during formation of the grooves, and, in a print head having an ink jet speed more than 4.5 m/s, said ratio of piezoelectric constant $d_{15}$ to said elastic compliance $S_{E44}$ of each of said side walls varies by 4 or less and not zero with respect to any other side wall in order that the variation of ink jet speed of each of said ink chambers falls within ±0.5 m/s upon application of a constant drive voltage to said electrodes from the voltage source.

2. An ink jet apparatus comprising:

a first plate comprising a piezoelectric ceramic plate having spaced side walls therein and electrodes disposed on each of said side walls; and a second plate coupled to said first plate, said first plate and said second plate defining ink chambers delineated at least by said spaced side walls of said first plate, said ink chambers being expandable and contractible upon application of voltage to said electrodes, wherein said piezoelectric ceramic plate has a piezoelectric constant $d_{15}$ and an elastic compliance $S_{E44}$ and a ratio of said piezoelectric constant $d_{15}$ to said elastic compliance $S_{E44}$, and, wherein in a print head having an ink jet speed more than 4.5 m/s, the ratio of said piezoelectric ceramic plate in each said side wall varies due to changes in said piezoelectric ceramic plate during formation by no more than 4 and greater than 0 with respect to any other side wall in order that the variation of ink jet speed from each ink chamber falls within ±0.5 m/s upon application of a constant drive voltage to said electrodes.

3. The ink jet apparatus of claim 2 wherein said side walls have a height and a width and a height to width ratio in a range of 2 to 9.

4. The ink jet apparatus of claim 3 wherein said height to width ratio is in a range of 2.5 to 8.

5. The ink jet apparatus of claim 3 wherein said height to width ratio is 4.

6. The ink jet apparatus of claim 3 wherein said piezoelectric ceramic plate has a void ratio of 10% or less and has an average crystal grain diameter of 10 μm or less and greater than 0.

7. The ink jet apparatus of claim 6 wherein said void ratio is 5% or less.

8. The ink jet apparatus of claim 6 wherein said average crystal grain diameter is 5 μm or less and greater than 0.

9. The ink jet apparatus of claim 2 wherein said piezoelectric ceramic plate has a piezoelectric constant $d_{15}$ and an elastic compliance $S_{E44}$ and a ratio of said piezoelectric constant $d_{15}$ to said elastic compliance $S_{E44}$ is 10 or more.

10. The ink jet apparatus of claim 9 wherein said ratio of said piezoelectric constant $d_{15}$ to said elastic compliance $S_{E44}$ is 12 or more.

11. The ink jet apparatus of claim 9 wherein said piezoelectric ceramic plate has a void ratio of 10% or less and has an average crystal grain diameter of 10 μm or less and greater than 0.

12. The ink jet apparatus of claim 11 wherein said void ratio is 5% or less.

13. The ink jet apparatus of claim 11 wherein said average crystal grain diameter is 5 μm or less and greater than 0.

* * * * *